US010441008B2

(12) United States Patent
Hamilton

(10) Patent No.: US 10,441,008 B2
(45) Date of Patent: Oct. 15, 2019

(54) PROTECTION DEVICE

(71) Applicant: Victoria Hamilton, Gourock (GB)

(72) Inventor: Victoria Hamilton, Gourock (GB)

( * ) Notice: Subject to any disclaimer, the term of this patent is extended or adjusted under 35 U.S.C. 154(b) by 331 days.

(21) Appl. No.: 15/122,016

(22) PCT Filed: Feb. 27, 2015

(86) PCT No.: PCT/GB2015/050585

§ 371 (c)(1),
(2) Date: Aug. 26, 2016

(87) PCT Pub. No.: WO2015/128672

PCT Pub. Date: Sep. 3, 2015

(65) Prior Publication Data

US 2017/0013893 A1 Jan. 19, 2017

(30) Foreign Application Priority Data

Feb. 28, 2014 (GB) ..... 1403533.1

(51) Int. Cl.
*A41D 13/00* (2006.01)
*A41D 13/06* (2006.01)
*A41D 13/08* (2006.01)

(52) U.S. Cl.
CPC ..... *A41D 13/065* (2013.01); *A41D 13/0005* (2013.01); *A41D 13/08* (2013.01)

(58) Field of Classification Search
CPC ... A41D 13/065; A41D 13/0005; A41D 13/08
See application file for complete search history.

(56) References Cited

U.S. PATENT DOCUMENTS 573,919 A * 12/1896 Rice ..... A41D 13/065 2/24
1,087,863 A * 2/1914 Andrews ..... A41D 13/065 2/24
1,269,829 A * 6/1918 Lumley ..... A41D 13/0568 2/24
1,293,240 A * 2/1919 Summers ..... A41D 13/0568 2/24
1,753,055 A * 4/1930 Matheson ..... A41D 13/0568 2/24

(Continued)

FOREIGN PATENT DOCUMENTS

CA 2263028 A1 8/2000
CN 102458167 A 5/2012
GB 195592 A 11/1923

OTHER PUBLICATIONS

International Search Report for International Application No. PCT/GB2015/050585 dated May 15, 2015.

(Continued)

*Primary Examiner* — Khaled Annis
(74) *Attorney, Agent, or Firm* — Fitch, Even, Tabin & Flannery LLP

(57) ABSTRACT

The present invention provides body part protectors which comprise multiple discrete and optionally removable/replaceable shock absorbing elements. The body part protectors of this invention offer superior protection to body parts such as knees and elbows as compared to other devices and/or those devices which comprise single shock absorbing elements.

17 Claims, 12 Drawing Sheets

(56) References Cited

U.S. PATENT DOCUMENTS

| | | | |
|---|---|---|---|
| 1,785,213 | A | 12/1930 | Shotwell |
| 4,213,202 | A | 7/1980 | Larry |
| 4,642,814 | A | 2/1987 | Godfrey |
| 6,807,682 | B1 | 10/2004 | Shircliff |
| 2006/0021104 | A1 | 2/2006 | Weissman |

OTHER PUBLICATIONS

Written Opinion of the International Searching Authority for International Application No. PCT/GB2015/050585 dated Sep. 3, 2015.
App. No. 201580022793X; Chinese Examination Report dated Sep. 25, 2017; pp. 1-8.
App. No. 5 707 757.9; EPO Examination Report dated Aug. 8, 2017; pp. 1-5.

* cited by examiner

PROTECTION DEVICE

CROSS-REFERENCE TO RELATED APPLICATION

This application is a U.S. national phase application of International Application No. PCT/GB2015/050585, filed Feb. 27, 2015, designating the United States, which claims priority to UK Patent Application No. 1403533.1, filed Feb. 28, 2014, which are incorporated by reference herein in their entirety.

BACKGROUND OF THE INVENTION

People who spend long periods of time resting on a surface tend to suffer pain and/or injuries on the body parts in contact with the surface. For example, activities that require kneeling on hard surfaces during prolonged periods of time can adversely affect professionals in the building, flooring and/or gardening industries.

Furthermore, people involved in leisure activities may suffer injuries from sudden impacts of a body part against a hard surface. For example, skaters/roller bladers, cyclists, runners and people involved in activities wherein an impact against a hard surface is likely, would benefit from a protective device that would mitigate the consequences of the impact. Joints are more exposed and therefore they are particularly vulnerable against this type of pain/injury.

Known body part protection devices comprise a cushioning means, normally in the form of a foam, that absorb part of the strain of the impact and/or weight of the user by deforming itself. The protection offered by of these devices is generally limited since the protective mechanism is based on the deformation of a material with limited elasticity. In the case of foams, this normally results in a permanent deformation of the foam, which is accompanied by decreased protection capability.

This problem was partially solved in GB2467646A by providing a cushioning pad comprising a network of tubular elements interconnected by ribs, which provides protection by deformation of the structure under the weight of the user. This invention presents a plurality of contact points of the device on the surface and may therefore provide stability on a static position, but that might be detrimental upon moving across a surface. U.S. Pat. No. 6,336,220B1 also provided a body part protector with a honeycomb element for absorbing impact load sandwiched between a forward facing load spreading layer and a foam backing.

Furthermore, people who require to kneel for prolonged periods of time can suffer especially acute pain/injuries upon shifting their body weight to reach different locations within the work surface. This problem was addressed in US2008/0289073 A1 by providing a flexible knee pad comprising a knee pad cushion adapted to rotate on a flat surface contact base in order to deflect pressure away from the user's knee caps during the movement of rocking back and forth. This invention, on the other hand, may restrict the movement of sideways rotation of the user since the device can only rock back and forth, and provides a very stable base that will secure the position of the worker in one location of the work surface, but may hinder the movement across it.

The object of the present invention is to mitigate some of the problems of the prior art by providing body part protectors which comprise multiple discrete shock absorbing elements to offer superior protection to body parts than devices which comprise single shock absorbing elements, while allowing the user to move across the contact surface comfortably.

SUMMARY OF THE INVENTION

The present invention is based on the finding that body part protectors which comprise multiple discrete and optionally removable/replaceable shock absorbing elements offer superior protection to body parts than devices which comprise single shock absorbing elements.

Thus the invention provides a device for protecting a body part, said device comprising:

a body part contact portion;

a surface contact portion; and a plurality of discrete shock absorbing elements disposed therebetween.

It should be noted that throughout this specification the term comprising is used to denote that embodiments of the invention "comprise" the noted features and as such, may also include other features. However, in the context of this invention, the term "comprising" encompasses embodiments in which the invention "consists essentially of" the relevant features or "consists of" the relevant features. For example, while this invention provides a device of protecting a body part comprising a body part contact portion; a surface contact portion; and a plurality of discrete shock absorbing elements disposed therebetween, the invention may further provide a device consisting (or consisting essentially of) one or more of these features.

For example, the invention may provide a device for protecting a body part, said device comprising:

a body part contact portion;

a surface contact portion; and a shock absorbing element disposed therebetween, wherein the shock absorbing element comprises, consists essentially or consists of a plurality of discrete shock absorbing elements.

In use, the device may protect or cushion a body part from (direct) contact with a surface—in particular hard surfaces such as walls, floors, ceilings, roads and the like. The reader will appreciate that direct, unprotected contact and in particular direct, unprotected, prolonged contact, between a body part and a surface, for example a hard surface, can be painful.

The device of the present invention is particularly useful for protecting the user from pain and/or damage to a body part caused by prolonged contact of said body part against a surface (particularly a hard surface). One of skill will realise that activities that require leaning against a surface in a static position for prolonged periods of time, may cause pain and/or damage to the body part against the surface.

Moreover, any unprotected contact occurring as a result of a significant impact (occurring perhaps as a result of a fall or accident) between a body part and a surface may risk serious injury to that body part. Thus, the devices of this invention may be used to protect body parts from injury and/or pain occurring as a result of contact between the body part and a surface.

The devices disclosed herein may be used by trades people such as, for example, builders, labourers, joiners, shop fitters, road layers, plumbers, floor layers, carpet layers, gardeners, roofers, carpenters and the like to protect, for example, their knees and/or elbows from injury or pain occurring as a consequence of unprotected and/or prolonged contact with (hard) surfaces. For example, people who, as a result of their jobs, spend a lot of time on their hands and knees may use the devices of this invention to reduce injury or pain which might occur as a consequence of unprotected contact or prolonged contact between their knees/elbows and/or other body parts and surfaces. The devices of this invention may also be used by sports people or people engaging in recreational or leisure activities and/or sports where contact between body parts and surfaces is likely. For example, the devices of the invention may be used by cyclists, skate boarders, skiers, snowboarders, roller skaters/bladers, jockeys and the like.

The body part may be any body part at risk of injury through contact with a surface. For example, the device of this invention may be used to protect any part of the head, neck, torso, abdomen, arms, wrists, hands, legs or feet. The devices of this invention may be used to protect joints such as, for example, the shoulders, wrists, elbows and/or knees from injury and/or pain occurring as a consequence of contact or prolonged contact with a surface.

Within the context of the present invention, a joint is the site of a connection, junction or union between bones, especially one that allows the motion of the bones. Thus, a joint may be a moveable connection between two or more bones. The term "joint" therefore embraces both knee and elbow joints. A joint may have an "apex". The "apex" of a joint may be the most prominent (or furthest protruding) part of the joint. For example, the apex of a knee joint may correspond to the patella and/or the centre point thereof. In the case of an elbow joint, this may correspond to the olecranon of the ulna, which, when the elbow is bent, is the portion of the joint which protrudes the most.

Thus, this invention provides a device for protecting a body part, said device comprising:

a body part contact portion;

a surface contact portion; and a plurality of discrete shock absorbing elements disposed therebetween;

wherein the body part is one or more selected from the group consisting of:

a joint;

a knee; and an elbow.

In one embodiment, the present invention provides a knee protector, the knee protector comprising:

a knee contact portion;

a surface contact portion; and a plurality of discrete shock absorbing elements disposed therebetween.

In another embodiment, the present invention provides an elbow protector, the elbow protector comprising:

an elbow contact portion;

a surface contact portion; and a plurality of discrete shock absorbing elements disposed therebetween.

It should be understood that the devices of this invention are not limited to use in humans and may find application in the protection of animal body parts too. For example, a device of this invention could be applied to a body part of an animal to protect it from contact with surfaces during a sporting event, a leisure activity and/or transportation and the like. Thus the devices of this invention may find particular application as body part protectors for use on, for example, livestock or horses (including race horses). It should be noted, that as with devices for human use, the body part protectors of this invention may be used to protect animal joints such as ankle, toe, knee, elbow, shoulder joints and the like.

The device of this invention may be releasably attached to a body part to be protected. The device may comprise means for securing or releasably securing the device to a body part to be protected. For example, the device may be releasably secured to locations above and/or below (for example either side of) a body part, for example a joint, to be protected. In the case of a device for protecting a knee or an elbow, the device may be releasably attached to the upper leg (thigh) or upper arm (for example around the bicep) and/or the lower leg (around the shin) and or lower arm (for example around the forearm)

For example, the device may comprise straps which may be tied or otherwise secured around a body part. The means for attaching the device to a body part may comprise one or more releasable fastenings including, for example, loop and hook type fastenings.

The body part contact portion may be formed of any suitable material or combination of materials including (but not limited to) for example hard or resilient material or materials, metal, plastic, rubber (natural or synthetic), wood, fabric, composite materials (fibre glass, carbon fibre and the like), and any combination thereof.

The body part contact portion may be formed and adapted to enclose, surround, engage, accommodate or fit with, around or against a particular body part to be protected. The body part contact portion may take any shape or form—generally speaking though the shape or profile of any inside surface of the body part contact portion will mirror (or be formed to mate with) the contours of the body part to be protected. The outside surface of the body part contact portion may take any form—for example it may be curved or planar in nature. The outside surface may be profiled in some way. For example, it may define lateral and/or longitudinal ribs.

Typically, the body part contact portion may comprise or consist/consist essentially of a cradle which accommodates, houses or fits against or around or at least partially encloses the body part to be protected.

The cradle may be moulded to fit the body part—for example, the cradle may be specifically designed to fit the shape of a particular body part and/or a body part of a particular individual. Where the body part is a joint, the cradle may accommodate at least some movement of that joint. A cast of a body part to be protected with a device of this invention may be used in the manufacture of the body part contact portion, or any cradle thereof, to ensure a proper fit. The body part contact portion may, in use, accommodate a knee or elbow and movement thereof, such as bending, straightening and/or twisting. In addition to comprising a cradle which accommodates a joint to be protected, the body contact portion may further comprise protective shields which extend therefrom. These protective shields may take the form of guards which extend to protect or cover at least part of a the body immediately above and/or below the relevant joint. For example in the case of a knee protector, the device may body contact portion may comprise a cradle for the knee and one or more guard(s) which extend therefrom to protect at least part of the thigh and/or shin (for example the front parts of the thigh and/or shin). Similarly, an elbow protector of this invention may comprise a body contact portion with a cradle for the elbow and guards which extend therefrom to protect at least part of the forearm and/or upper arm. The body part contact portion or any cradle thereof may comprise a layer of padding or wadding on an inside surface of the body part contact portion. The layer of padding or wadding may serve as a cushion between the body part and any hard material of the body part contact portion (or cradle thereof). The layer of padding or wadding may comprise a soft material, for example a silicone, (encapsulated) gel, foam, plastic, fabric, sponge and/or rubber material which is in contact with the body part to be protected and thus prevents direct contact between the body part and any hard material of the body part contact portion of the device.

The layer of padding or wadding may be configured to extend beyond the body contact portion. In use, the layer of padding or wadding may be configured to extend beyond the body contact portion and surround, wrap or envelope at least part of the body part to be protected. In embodiments of the invention in which the protection device is a knee protector, the layer of padding or wadding may be configured to extend beyond the body contact portion and surround, wrap or envelope at least part of the user's shin and/or thigh. The means for attaching the device to a body part, for example straps, may secure the device to the body part over the layer of padding or wadding. Beneficially, a layer of padding or wadding that surrounds or hugs the user's shin may further assist in securing the device in the correct position. A strap may be configured to be fastened over the layer of padding or wadding to firmly secure the device to the user's shin or thigh. Without wishing to be bound by theory, fastening the straps over a layer of padding or wadding may increase the comfort of the user by reducing the extent of rubbing or pressure applied directly on the user's skin, while securing the device to the body part to which it is attached firmly.

Thus, the various devices of this invention may comprise a layer of padding or wadding formed and adapted not only to line the body contact portion, but also to provide flaps which can be wrapped around the user. The device may comprise two pairs of padding or wadding flaps (or wings), each pair designed to wrap around at least part of a user's body. The flaps of padding or wadding may extend from the device in a manner which permits one pair to be wrapped around a part of the body below the joint to be protected and the other pair to be wrapped around part of the body above the joint to be protected. In the case of a knee protector, one pair of padding/wadding flaps (or wings) may be wrapped around at least part of the user's shin and the second pair may be wrapped around at least part of the user's thighs. The flaps and/or wings may be held or secured in place by means of the fastenings provided to secure the device of the invention to the body part to be protected. The surface contact portion of the device of this invention may be formed and adapted for contact with one or more different types of surface including, but not limited to, for example floors, ceilings, walls, roads and the like.

The surface contact portion may comprise a hard or resilient material such as (but not limited to), for example a plastic, metal, rubber (natural or synthetic), wood, fabric, composite materials (fibre glass, carbon fibre and the like) or any combination thereof.

The surface contact portion may take any shape or form. For example, the surface contact portion may be curved or flat/planar. The shape of the surface contact portion may mirror or approximate the shape of the body part contact portion. The surface contact portion may comprise inner and outer surfaces of different profiles. For example, the inner surface may adopt a profile corresponding to the profile the outer surface of the body part contact portion, whereas the outer surface of the surface contact portion may comprise a flat or planar surface. Alternatively, the outer surface may be convex to allow for rotation and/or movement of the device when in use, without displacement of the protective device across the surface. Moreover, a convex outer surface of the surface contact portion may be of particular advantage when the user wants to shift/move across the contact surface.

The surface contact portion may comprise, consist essentially of or consist of, a solid and/or continuous component. In one embodiment, the surface contact portion may consist of a single solid and/or continuous component to provide a single point of contact with the surface wherein in use.

Alternatively, the surface contact portion may be discontinuous. In another embodiment, the surface contact portion may comprise, consist essentially of or consist of a discontinuous component which may provide several points of contact with the surface when in use.

The outer surface of the surface contact portion may be formed and adapted to grip a surface. For example, the outer surface of the surface contact portion may comprise ribs, bumps or other (discrete) projections or the like (running laterally and/or longitudinally).

The surface contact portion may comprise an additional surface protection layer or sole that is releasably attached to the (outer) surface of the surface contact portion so that, when the device is in use, the surface contact portion sole or surface protection layer is in contact with the surface—this allows the grip of the device (or at least the surface contact portion thereof) to be adapted for different surfaces. For example, the surface contact portion sole or surface protection layer may comprise a (relatively) soft material such as rubber, fabric, silicone, plastic, sponge—for use on delicate or polished surfaces. Alternatively, the surface contact portion sole or surface protection layer may comprise a (relatively) hard material such as plastic, glass, metal, rubber (natural or synthetic), wood, fabric, composite materials, fibre glass and/or carbon fibre. In one embodiment, the surface contact portion comprises a releasably attachable sole. The surface contact portion sole or surface protection layer may increase the grip of the device to the surface. Alternatively, the sole or surface protection layer may be polished and allow for easier sliding and/or shifting across the surface, without damaging, scratching and/or marking said surface.

The surface contact portion or any sole or surface protection layer thereof may be polished to enhance the movement across a surface and/or to avoid scratching or damaging a contact surface. The surface contact portion sole or surface protection layer may comprise a material configured not to leave marks on a surface, such as a translucent or light coloured material. Beneficially, in use, the material of the surface protecting layer may prevent the device from leaving marks on the surface on which the device rests.

Alternatively, the surface contact portion and/or sole may have protrusions to adapt to uneven surfaces and provide grip. Thus, the surface contact portion sole may increase the grip of the device on a surface.

The surface contact portion sole or surface protection layer may be interchangeable to provide the user with the optimum performance on each type of contact surface. Moreover, the surface contact portion sole or surface protection layer can be replaced to avoid wear and tear of the protective device of the invention.

Thus, this invention provides a device for protecting a body part, said device comprising:

a body part contact portion;

a surface contact portion; and a plurality of discrete shock absorbing elements disposed therebetween;

wherein the surface contact portion comprises a releasably attachable surface protection layer or sole. The surface protection layer or sole may be fixed to an outer surface of the surface contact portion such that when the device is in use, the sole is in contact with the surface.

The body part contact portion and the surface contact portion may be (approximately) the same or a different size and/or shape. For example, the body part contact portion and the surface contact portion may have the same surface area. However, the surface contact portion may have a smaller or larger surface area than the body part contact portion.

In one embodiment, the surface contact portion has a greater surface area than the body part contact portion. This may provide enhanced grip of the protecting device on the surface by increasing the contact area between the surface and the surface contact portion of the device. A protecting device with a surface contact portion of a greater size and/or surface area than the body part contact portion may distribute the weight or the user more evenly across the surface, providing better support to the joint and/or body part of the user and a greater grip on the surface.

In another embodiment, the surface contact portion may have a smaller surface area than the body part contact portion. This may provide a decreased contact area with the surface, thus enhancing the mobility of the user across said surface. A protective device with a surface contact portion of smaller area than the body part contact portion may offer certain advantages over other devices. By a way of example, a protective device with a surface contact portion of smaller area than the body part contact portion may have a lowered manufacture cost and may enhance the mobility the user across the contact surface, for example while crawling, sliding or shuffling across said surface.

Thus, this invention provides a device for protecting a body part, said device comprising:

a body part contact portion;

a surface contact portion; and a plurality of discrete shock absorbing elements disposed therebetween;

wherein the surface contact portion has a smaller surface area than the body part contact portion.

In one embodiment, the surface contact portion comprises at least a flat outer surface which, when the device is in use, is in contact with a surface. A flat surface provides full contact between the surface contact portion and the surface. In an alternative embodiment, the surface contact portion may comprise a curved and/or convex outer surface. A curved and/or convex shape or profile provides a single contact point with the surface (as compared to a device with a contact surface portion having a flat outer surface). As such, a curved surface contact portion may allow the user to rotate or displace their bodyweight without shifting across the contact surface, for example when leaning. Moreover, the decreased contact area between the surface and the surface contact portion of the protective device may enhance the mobility of the user across the contact surface. Furthermore, the curved shape of the surface contact portion reduces the likelihood of the device of getting hooked on corners, protrusions and/or other obstacles of the surface compared to a flat shape.

Thus, this invention provides a device for protecting a body part, said device comprising:

a body part contact portion;

a surface contact portion; and a plurality of discrete shock absorbing elements disposed therebetween;

wherein the surface contact portion comprises a curved and/or convex outer surface. In use, the curved and/or convex surface of the surface contact portion may be in contact with a surface.

The body part contact portion and the surface contact portion may be held, spaced apart, by a plurality of discrete shock absorbing elements. The device may be constructed so that the shock absorbing elements may be springs and/or columns of a deformable material that are disposed perpendicularly between the two stacked parallel planes defined by the body contact portion and the surface contact portion. In one embodiment, the shock absorbing elements comprise springs and/or columns of a deformable material.

The shock absorbing elements may be enclosed within a body or housing comprising the body part contact portion and the surface contact portion. Alternatively, the shock absorbing elements may be exposed to the air by lacking an enclosure body or housing. Except for any components used to releasably receive a shock absorbing element, the plurality of shock absorbing elements may be the only components disposed between the body part contact portion and the surface contact portion.

Each of the shock absorbing elements may be disposed between the body part contact portion and the surface contact portion of the device. Thus the surface contact portion of the device of this invention is spaced from the body part contact portion by one or more discrete sock absorbing elements disposed in a perpendicular plane (relative to the planes of the body contact portion and the surface contact portion) therebetween.

Each of the shock absorbing elements may extend from the body part contact portion to the surface contact portion of the device. Typically, one end of a shock absorbing element is connected to the body part contact portion and another end to the surface contact portion. Typically, one end of each shock absorbing element is connected to the outside surface of the body part contact portion and the other end of each shock absorbing element is connected to the inside surface of the surface contact portion. Nevertheless, it should be understood that the shock absorbing elements of the device may extend from any part of the surface contact portion to any part of the body part contact portion.

The devices of this invention may comprise a protective cover, skirt or sheath. The skirt/sheath may be disposed between the body contact portion and the surface contact portion of the device and be formed and adapted to prevent debris (including building debris), dust, water and other contaminants into the space between the body contact portion and the surface contact portion. In this way, the protective skirt or sheath prevents contaminants (including dirt and water) from affecting the shock absorbing elements. Each shock absorbing element may be individually wrapped or protected by some cover or material. Additionally, or alternatively, the device may be provided by a single cover (in the form of a skirt or sheath) which envelopes, protects and/or covers all of the shock absorbing elements. The protective cover, skirt or sheath may encircle the outer perimeter defined by the shock absorbing elements.

The protective cover, sheath and/or skirt may be flexible. The protective cover, sheath and/or skirt may be made of plastic and/or synthetic/natural rubber. The cover, sheath and/or skirt may comprise longitudinal running ribs or corrugations that allow the skirt to compress and/or expand in use (particularly as the space between the body contact portion and surface contact portion of the device reduces/increases in use). It should be understood that, within the context of the present invention, the outside or outer surface of the body part contact portion is the surface which, when the device is in use, does not face the body part to be protected. Similarly, the inside or inner surface of the surface contact portion is the surface which, when the device is in use, is not in contact with the surface.

In use, a device of this invention is fixed, for example, releasably fixed to a body part to be protected. When the body part is brought towards a surface, the surface contact portion of the device will make contact with the surface first, thus protecting the body part from any direct contact with the surface. Should the user continue to apply force or weight to the body part, for example in the direction of the surface, the body part contact portion of the device will move towards the surface contact portion but the movement will be dampened, inhibited and/or restricted by the presence of the at least one shock absorbing element disposed between the body part contact portion and the surface contact portion.

Moreover, in use and when in contact with a surface, there may be relative movement of the body part contact portion. Specifically, when the surface contact portion is in contact with a surface, and subject to any curvature of the surface contact portion, it may be relatively immobile. However, the body part contact portion may exhibit an ability to move relative to the surface contact portion. The body part contact portion may roll, pitch, yaw and/or move up and down (relative to the surface portion) as the user moves the body part about and/or alters their weight distribution.

The at least one shock absorbing element may comprise a resilient material or device. In one embodiment, the shock absorbing elements comprise springs and/or columns of a deformable material. By way of example, the shock absorbing element may comprise an elastomeric material such as a natural and/or synthetic rubber. The shock absorbing element may comprise a rubber element, for example a rubber disc or spacer. The shock absorbing element may comprise a metal component. The metal component may comprise a spring. The shock absorbing element may comprise a torsion element/bar.

One or more (for example all) of the shock absorbing elements may be separately formed. Additionally or alternatively, one, some or all of the shock absorbing elements may be integrally formed with the body part contact portion and/or surface contact portion of the device.

One or more (perhaps all) of the shock absorbing elements disposed between the body contact portion and surface contact portion may be removable, replaceable and or movable.

Devices in which one, some, or all of the shock absorbing elements are separately formed may allow users to change shock absorbing elements in the event of damage or, for example, if the weight of the user requires that a more or less resilient shock absorbing element (or elements) are required. It may also allow the user to alter the distribution of the shock absorbing elements and/or alter the degree of shock absorption in one or more regions of the device. In one embodiment, one or more of the discrete shock absorbing elements can be removed from the device. In another embodiment, the present invention provides a device for protecting a body part, said device comprising:

a body part contact portion;

a surface contact portion; and a plurality of discrete and separately formed shock absorbing elements disposed therebetween, wherein one or more or each of the shock absorbing elements is removable and/or interchangeable.

The shock absorbing elements can be arranged in a plurality of configurations. For example, the shock absorbing elements may be arranged in rows, zig-zag or a circular configuration, for example a circular configuration across the parallel stacked surfaces of the body contact portion and the surface contact portion. The shock absorbing elements may be arranged in a circular configuration around a vertical axis located in the centre of the surface contact portion. This provides equal distribution of the user's weight across the entire surface contact portion and avoids the concentration of stress and/or force on a single point of the body part to which the device is attached. Moreover, the circular arrangement of the discrete shock absorbing elements allows 360° rotation of the body part and assists the weight distribution and shifting of the user's weight across the device when leaning, crawling and/or shuffling across the surface.

The shock absorbing elements may not be located directly under the apex or centre point of the user's joint. One of skill will appreciate that when not protected, it is the most prominent and/or protruding parts of a joint which are most likely to be injured through impact or contact with a surface. While the devices of this invention offer protection to joints, the shock absorbing elements may be placed and/or arranged such that there are no shock absorbing element(s) positioned directly underneath (in use) the most prominent or protruding part of a joint and/or its apex.

The shock absorbing elements may be arranged circumferentially around a joint or at least around the apex or centre point of a joint. In this arrangement, there may be no shock absorbing element placed or located such that the shock absorbing element is (when in use or affixed to a user) located directly opposite, or disposed beneath the apex or centre of the joint. Without wishing to be bound by theory, a disposition of the shock absorbing elements surrounding the joint apex rather than directly underneath it may reduce the strain placed on the users joint and distribute the pressure more evenly across the entire device. In embodiments in which the protection device is a knee protection device, the device may be configured so that, in use, there is no shock absorbing element disposed beneath at least the centre point of the patella. In embodiments in which the protection device is an elbow protection device, the device may be configured so that, in use, there is no shock absorbing element disposed beneath at least the centre point of the olecranon of the ulna.

The body part contact portion and/or the surface contact portion of the device of this invention may comprise a plurality of ports adapted to receive or accommodate a shock absorbing element. For example, the body part contact portion and/or the surface contact portion may define one or more (for example a plurality) of apertures, each sized and dimensioned to releasably receive a shock absorbing element.

In one embodiment, the body contact portion and the surface contact portion define ports for releasably receiving the shock absorbing elements.

The ports may take the form of walled recesses formed and adapted to accommodate the shock absorbing elements and/or any external diameter thereof. Additionally, or alternatively, the ports may comprise projecting studs/stumps/abutments or lugs formed and adapted to fit within any internal void or space of a shock absorbing element. For example, where the shock absorbing element is a spring, the projecting stud or lug may fit inside the spring. Each shock absorbing element may be held in place by means of a port comprising a walled recess and a port comprising a projecting stud or lug. For example in the case of any given shock absorbing element, either a walled recess or a projecting stud or lug is provided on the body contact portion and the other of the protecting stud/lug or walled recess on the surface contact portion. As such, one end of each shock absorbing element is fitted into a walled recess and the other end is fitted over a projecting stud or lug.

The walled recess and the projecting stud or lug may co-operate to ensure that the shock absorbing element does not come free in use. Under compression, the walled recess present on either of the body contact portion or the surface contact portion and the projecting stud/lug (present on the other of the body contact portion or surface contact portion), are brought together and the projecting stud/lug may nest within the walled recess. This ensures that the shock absorbing element under compression (for example a spring) is held or disposed between the inside surface of the walled recess and the outside surface of the projecting stud/lug—thus substantially preventing sideways movement of the shock absorbing element.

Additionally, or alternatively, a flexible member (for example a cord) may extend between the ports. For example a flexible cord may extend from the centre of the walled recess present on the body contact portion and/or surface contact portion to the projecting stud/lug (present on the other of the body contact portion and/or surface contact portion). The flexible member compresses or wrinkles when the body contact portion and surface contact portions are brought together and when the body contact portion and surface contact portion of the device move apart, the flexible member extends, de-compresses or un-wrinkles. For example, when the device is not in use (or is not under compression), the flexible member may be taught. The flexible member further prevents the shock absorbing elements from breaking free of the ports.

The shock absorbing elements may be releasably attached to the ports defined by the body contact portion and/or the surface contact portion by means of shock absorbing element fixings/housings (referred to hereinafter as "housings"). The housings may be located on one or both ends of each shock absorbing element. The housings act as means of containing the shock absorbing elements and providing them with additional support to prevent displacements, twisting and/or buckling of the shock absorbing elements.

For example, the housings may take the form of caps covering one or both ends of each shock absorbing element. Alternatively, or additionally, the housings may take the form of a plate or plates onto which the shock absorbing elements are adhered/affixed. Each cap or housing may be then adhered/fixed to either end of the shock absorbing elements by means of an interference fit, a screw fit, a push fit, an adhesive and the like. For example, the shock absorbing element may be screwed onto a built in screw thread on the housing. For convenience, the shock absorbing element and housing configuration is referred to as "shock absorbing unit". In use, the housing parts of the shock absorbing unit may be located in the respective ports of the body contact portion and surface contact portion by means of an interference fit, a push fit, a screw fit, an adhesive fit and the like. Each shock absorbing unit may be releasably attached to the ports defined by the body contact portion and the surface contact portion.

The housings may comprise fasteners protruding from the surface opposite to that affixed to the body contact portion and/or surface contact portion. The fasteners may be configured to fit through the shock absorbing element. Without wishing to be bound by theory, the fasteners may assist in the correct location of the shock absorbing element within the housing. The fasteners may provide additional stability to the shock absorbing elements, for example by preventing lateral displacement while a force is applied to or removed from the device. As such, this invention provides a device for protecting a body part, said device comprising:

a body part contact portion;

a surface contact portion; and a plurality of removable or interchangeable discrete and separately formed shock absorbing elements disposed therebetween, wherein the ends of the shock absorbing elements are attached to shock absorbing element housings that can be releasably attached to the body contact portion and the surface contact portion.

Similarly, this invention provides a device for protecting a body part, said device comprising:

a body part contact portion;

a surface contact portion; and a plurality of removable or interchangeable discrete and separately formed shock absorbing units disposed therebetween, wherein the shock absorbing units comprise a shock absorbing element capped at one or both sides with a shock absorbing element housing, which housing can be releasably attached to the ports of the body contact portion and the surface contact portion.

Moreover, the present invention provides a device for protecting a body part, said device comprising:

a body part contact portion;

a surface contact portion; and a plurality of discrete and separately formed removable shock absorbing elements disposed therebetween;

wherein the body contact portion and the surface contact portion define ports and/or apertures adapted to releasably receive the shock absorbing elements.

Thus, in one embodiment, the shock absorbing elements, springs and/or columns of a deformable material, further comprise capped ends adapted to releasably engage with ports provided by the body contact portion and the surface contact portion.

Wherein in use, the shock absorbing units are located in a plane perpendicular to the plane defined by the tangent stacked planes of the outer surfaces of the body contact portion and the inner surface of the surface contact portion as well as perpendicular to the plane defined by the surface on which the device rests. As such, the shock absorbing units may resemble vertical columns located between the body contact portion and the surface contact portion, spacing them out.

The body and surface contact portions of the device described herein may be adapted to receive a plurality of shock absorbing elements. Depending on the user and/or level of protection required, one or more (up to the maximum permitted number) of shock absorbing elements may be used. The body contact portion and surface contact portion of the device may define as many ports as required to receive the shock absorbing elements. The body contact portion and surface contact portion of the device may define additional or spare ports to allow the shock absorbing elements and/or units to be moved about in a plurality of configurations.

The shock absorbing elements and/or shock absorbing units of the present invention may be purchased individually, for example to replace shock absorbing elements and/or units that are broken and/or to customise the resilience of the device according to the weight of the user and/or the activity to be performed wherein using the device. Similarly, the shock absorbing elements/units may be purchased in packs of the same or a plurality of shock absorbing deformability and/or compression properties. The skilled person will readily understand that this provides the user with the advantage of customising the device to provide the shock absorbing capability that suits each user and each purpose or use.

As stated, the body part contact portion and the surface contact portion may be fully or partially spaced apart. For example, an edge of the surface contact portion may meet an edge of the body part contact portion when the user applies weight and/or force on the device. The space between the body part contact portion and the surface contact portion may comprise or consist (essentially of) of air. For example, in addition to the plurality of discrete shock absorbing elements, there may not be any additional form of shock absorbing material—for example foam or the like, between the body part contact portion and the surface contact portion of the device. The default distance between the body contact part and surface contact part when the device is not in use is defined by the length of the shock absorbing elements. Each shock absorbing element may have the same length. The length of some or all of the shock absorbing elements may be the same or different. The length of the shock absorbing elements can be (independently) between 5 mm and 100 mm, between 10 mm and 60 mm, between 20 mm and 50 mm, between 30 mm and 40 mm. The length of the shock absorbing elements may be 20 mm-25 mm, for example 21 mm, 22 mm, 23 mm or 24 mm. Alternatively, the length of the shock absorbing element may be 25 mm. As such, the surface contact portion of the device and the body contact portion of the device may be spaced apart by either a uniform or regular (constant) distance or a variable distance.

The shock absorbing elements may each have the same or a different spring rate/stiffness. For example, the shock absorbing elements may each independently have a spring rate/stiffness of anywhere between about 1 and about 20 N/mm (and any value therebetween), for example, about 5-15 N/mm. The shock absorbing elements may each independently have a spring rate/stiffness of about 6, 7, 8, 9, 10, 11, 12, 13 or 14 N/mm stiffness. For example, the shock absorbing elements may have a spring rate/stiffness of about 6 N/mm, 8 N/mm and/or 14 N/mm. The shock absorbing element spring rate/stiffness values may vary within a ±0.1-0.5 N/mm range.

Shock absorbing elements for use in this invention may be obtained from Lee Spring®. For example useful shock absorbing elements may be those with a length of 22.224 mm, a spring rate (stiffness) of 8.33 N/mm and an outside diameter of 21.462 mm.

The device of the present invention may absorb the potential energy of a shock of a body part against a surface by means of the plurality of shock absorbing elements. For example, the shock absorbing elements may absorb between about 1% and about 100% of the pressure exerted on the body part, or between about 10% and about 90%, or between about 20% and about 80% or between about 60% and about 90%, or between about 60% and about 70% of the pressure exerted on the body part. The shock absorbing elements may be alternated, replaced or interchanged with shock absorbing elements of low, medium and/or high deformability and/or compression (or spring) rates. Shock absorbing elements with low spring rates may be suitable for light users, shock absorbing elements with medium spring rates may be suitable for medium-weight users and shock absorbing elements with high spring rates may be suitable for heavy users. Alternatively, a combination of shock absorbing elements with a plurality of spring rates may be optimal for the needs of a user of the protective device of the present invention.

As such, a device of the present invention comprising a body part contact portion, a surface contact portion and a plurality of shock absorbing springs disposed therebetween may absorb between 30% and 99% or between 50% and 80%, or between 60% and 70% of the pressure exerted on the body part.

The invention also provides a kit of parts comprising a body part protection device as described herein and/or a plurality of discrete shock absorbing elements and/or shock absorbing units for use with the device. The shock absorbing elements may have the same or varied deformability and/or compression properties.

The shock absorbing elements/units supplied with a kit of this invention may serve as replacements for broken or damaged elements or, if they have different properties and/or lengths etc., may be used to tailor the device to use on a specific type of surface, activity and/or to fit users of different weights.

The kit of the invention may further comprise one or more surface contact portion sole or soles that are releasably attached to the surface contact portion. For example, the surface contact portion sole may comprise a soft material such as rubber, fabric, silicone, plastic and/or sponge. Alternatively, the surface contact portion sole may comprise a hard material such as plastic, glass, metal, plastic, rubber (natural or synthetic), wood, fabric, composite materials, fibre glass and/or carbon fibre. Furthermore, the surface contact portion sole may be polished to enhance the movement across a surface and/or to avoid scratching or damaging a surface. Alternatively, the surface contact portion sole may have protrusions to adapt to uneven surfaces and provide grip.

The kit of the present invention may also comprise one or more strap(s) to releasably attach the body part protecting device to the user.

The kit of the present invention may further comprise instructions for use.

Thus, in a second aspect, the present invention provides a kit of parts, said kit comprising a plurality of shock absorbing elements and/or units for use with a body part protection device of the present invention. The shock absorbing elements and/or units of the kit may have the same or varied deformability and/or compression properties.

The kit may further comprise one or more of the elements selected from the group comprising:

a body contact portion;
a surface contact portion;
padding or wadding for use with the body contact portion;
one or more surface contact portion sole or soles;
one or more strap(s);
means of assembling the device and;
instructions for use.

The present invention also provides a body part protection device constructed, and arranged substantially as described with reference to and as illustrated in the accompanying drawings.

BRIEF DESCRIPTION OF THE DRAWINGS

The present invention will now be described with reference to the Figures which show.

DETAILED DESCRIPTION OF THE INVENTION

The present invention will now be described by way of example and with reference to the accompanying drawings.

Figure 1:
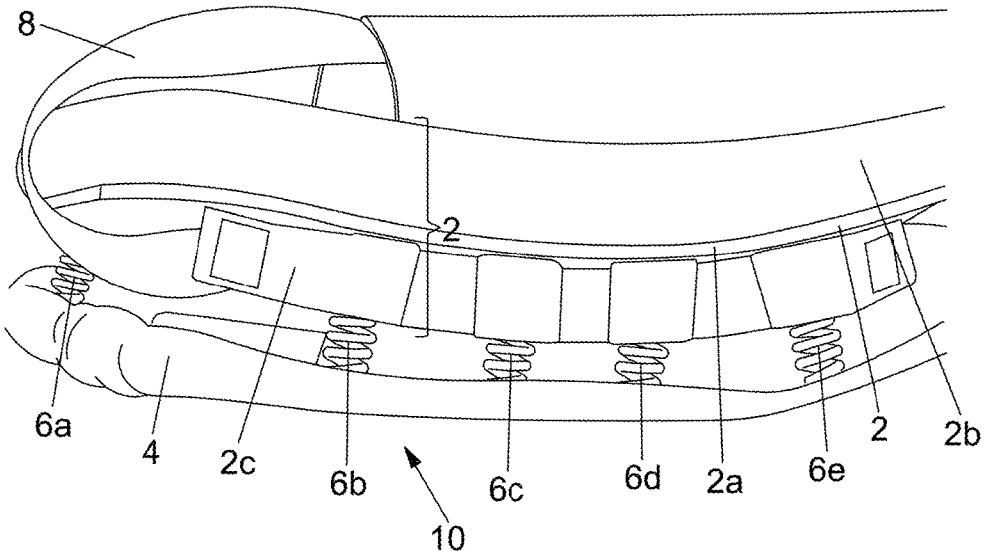
FIG. 1: Picture of a body part protecting device 10 according to one embodiment of the invention.

FIG. 1 is an image of body part protection device 10 according to one embodiment of the invention. The device comprises a curved body contact portion 2 comprising a hard material layer 2*a*, such as hard plastic. The body contact portion 2 is formed and adapted to receive the body part to be protected, in this case a knee. The body part contact portion 2 of device 10 further comprises a layer of padding or wadding 2*b* adjacent the layer of hard material 2*a*. In use, the wadding 2*b* is directly in contact with the knee and offers the user comfort and prevents direct contact between the knee and the hard material of part 2*a*. Body part contact portion 2 further comprises layer 2*c* which is bonded to the layer of hard material 2*a* and provides a means for attaching straps 8 to the device.

Device 10 further comprises surface contact portion 4, having a curved profile which, in this embodiment mirrors or mimics the shape and general curvature of body contact portion 2. The surface contact portion 4 comprises a curved convex surface which, when the device is in use, is in contact with the surface. The convex profile allows the user to rock, shift and/or slide on or across a surface. In use, the curved/convex surface of surface contact portion 4, enhances the user's mobility and their general safety.

Body part contact portion 2 and surface contact portion 4 are spaced apart by means of a plurality of discrete shock absorbing elements 6, which in this embodiment take the form of springs. This figure shows only some of the shock absorbing elements and these have been allocated reference numerals 6*a* through to 6*e*.

One end of each shock absorbing element 6 is connected to the body part contact portion 2 and the other end of each shock absorbing element is connected to surface contact portion 4. In this embodiment, the shock absorbing elements 6 are distributed in rows and they are the only component that bridges the space between the body contact portion and the surface contact portion of device 10 (indeed this is a feature of all of the body part protectors provided by this invention).

In this embodiment, four of the shock absorbing elements 6*b*-6*e* extend from part 2*c* of the body contact.

In use, the pressure exerted on a body part upon contact with the body part contact portion 2 is absorbed by the plurality of shock absorbing elements 6, which act as resilient spacers maintaining a (variable) distance between the body part contact portion 2 and the surface contact portion 4.

Device 10 further comprises straps 8, which are attached to part 2*c* of the body part contact portion. When device 10 is in use, straps 8 are secured to the user such that the device 100 protects the appropriate body part. The device 10 of this embodiment is to be secured to the body such that the body part contact portion is placed adjacent a knee—in this way device 10 offers protection to a knee against contact against a surface. Device 10 may be secured to a knee by fastening one of two straps 8 around an upper part of the leg (for example around part of the thigh) and the other strap around a lower part of the leg (for example around part of the calf).

Straps 8 comprise fastening means such as hook and loop fastening means (not shown here) to releasably secure the straps around a suitable body part and thereby secure the device to the user's body.

Figure 2:
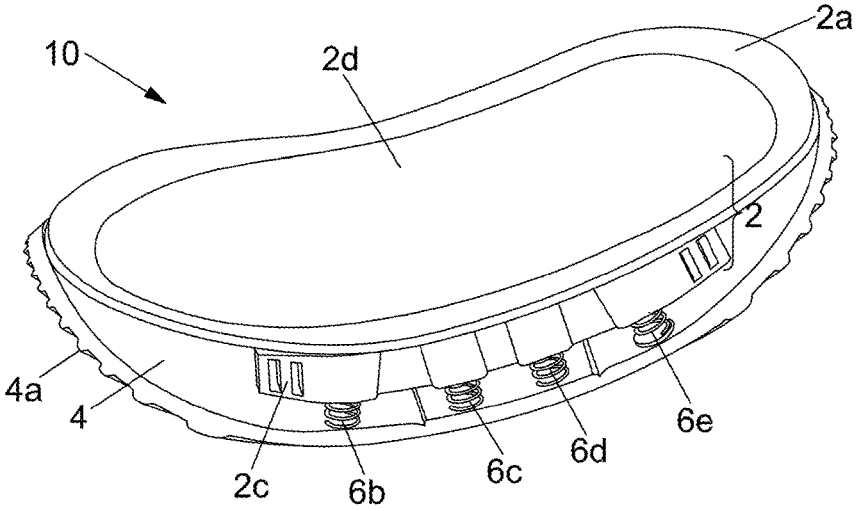
FIG. 2: 3D drawing of a perspective view of the body part protecting device 10 shown in FIG. 1.

FIG. 2 is a 3D perspective representation of the same device 10 shown without straps and wadding. Similar features have been identified using the same reference numerals. In this figure the curved profile of the surface contact portion 4 can be best appreciated. The body part contact portion 2 (shown without wadding layer 2*b*) is shown as comprising a moulded cradle 2*a* which fits around and/or adjacent the knee. Cradle 2*a* which may be made of a hard plastic material, defines central well 2*d* adapted to receive a user's knee and accommodate movement thereof. In this embodiment, surface contact portion 4 is shown to comprise grooves or ribs 4*a* that in use may improve a user's grip on a surface.

Figure 3A:
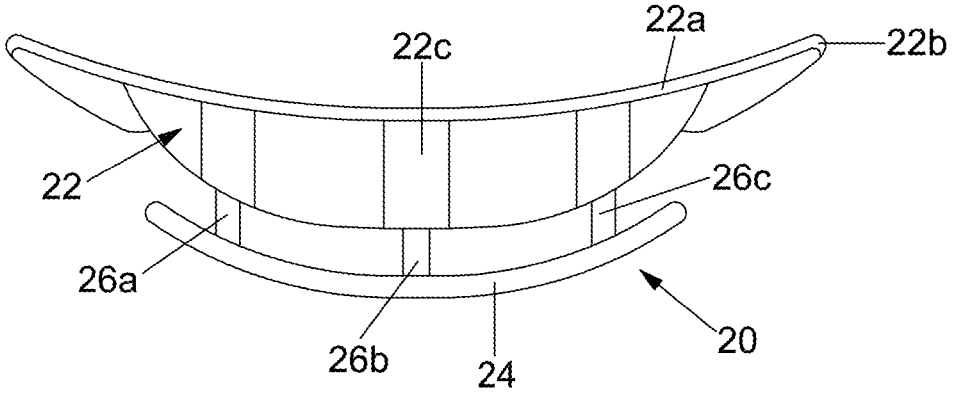
FIG. 3*a*: Side view of a body part protecting device 20 according to another embodiment of the invention.
Figure 3B:
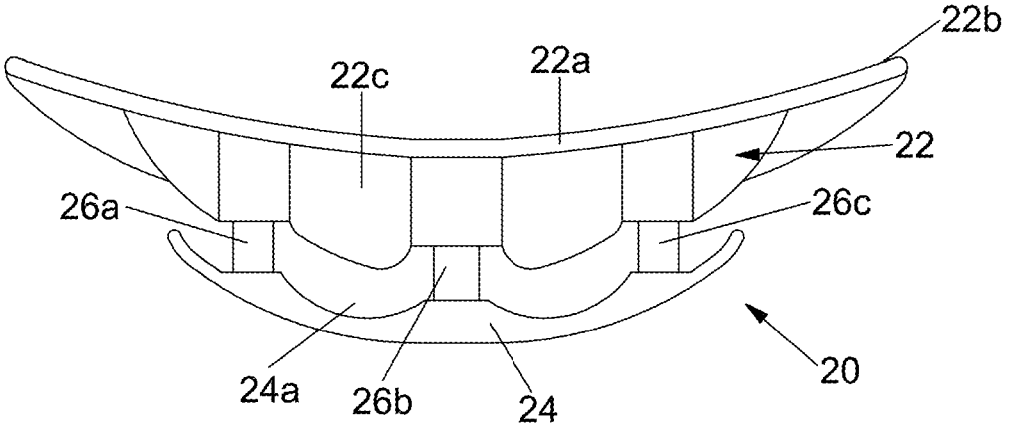
FIG. 3*b*: Side view of the body part protecting device 20 shown in FIG. 3*a*.
Figure 3C:
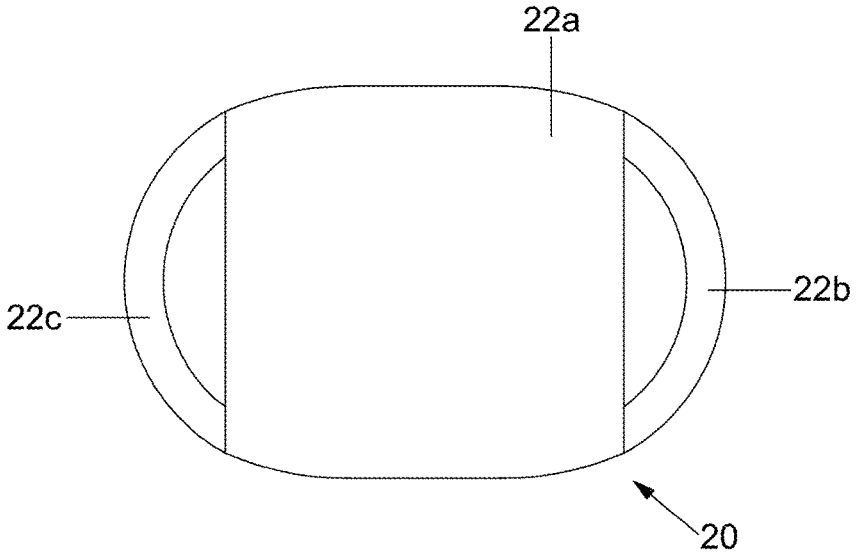
FIG. 3*c*: Top view of the body part protecting device 20 shown in FIGS. 3*a* and *b*.

FIGS. 3*a* and *b* represent side views and FIG. 3*c* represents a top view of a further body part protection device 20 according to an embodiment of this invention. Again, device 20 is adapted to provide a user with protection for a knee.

Device 20 comprises body part contact portion 22 which in this embodiment takes the form of moulded cradle adapted to enclose, surround, engage, accommodate or fit with, around or against a knee (not shown). The outer surface of the body part contact portion 22 (the surface that is not in direct contact with the knee) is curved and it defines a series of ribs 22*c* (best appreciated in FIG. 3*b*). Ribs 22*c* provide additional strength and increase the compression of the shock absorbing elements 26 (shown in FIGS. 3*a* and 3*b* are shock absorbing elements 26*a, b* and *c*), thus allowing the shock absorbing elements 26 to fully compress into a recess (not shown) in order to provide improved stability. Body contact portion 22 further defines rim 22*b* that provides a means for attaching straps (not shown) which may be used to secure the device 20 to the leg of the user in order to protect the knee of the user. Body contact portion 22 also comprises a cradle of hard material 22*a*.

Device 20 further comprises surface contact portion 24 which in this embodiment is a continuous curved/domed unit which, when device 20 is in use and placed against a surface, provides a single point of contact with the surface. Both the inner and outer surfaces of surface contact portion 24 are curved.

The shape and/or form of surface contact portion 24 allows the user to move or rotate or displace their body-weight without shifting across the surface. Moreover, the shape and design of the surface contact portion 24 enhances the user's mobility across the contact surface. The surface area of the surface contact portion 24 is smaller than that of body contact portion 22. This enhances the mobility of the user as in use, body contact portion 22 can move independently of the surface contact portion; furthermore, the movement of body contact portion 22 is not substantially or unduly impeded by surface contact portion 24. The smaller size of surface contact portion 24 also reduces the manufacturing cost of device 20.

FIG. 3*b* presents a side view of device 20 and best shown here is the inner profiled surface of surface contact portion 24 which defines grooves or channels 24*a* to accommodate the ribs 22*c* of the body contact portion 22.

Body part contact portion 22 and surface contact portion 24 are spaced apart by a plurality of the shock absorbing elements designated 26*a-c*. One end of each shock absorbing element 26*a-c* is connected to body part contact portion 22 and the other end of each shock absorbing element 26*a-c* is connected to surface contact portion 24.

In this embodiment, the shock absorbing elements 26*a-c* are the only elements located (or disposed) in the space between the body contact portion 22 and surface contact portion 24.

Figure 4A:
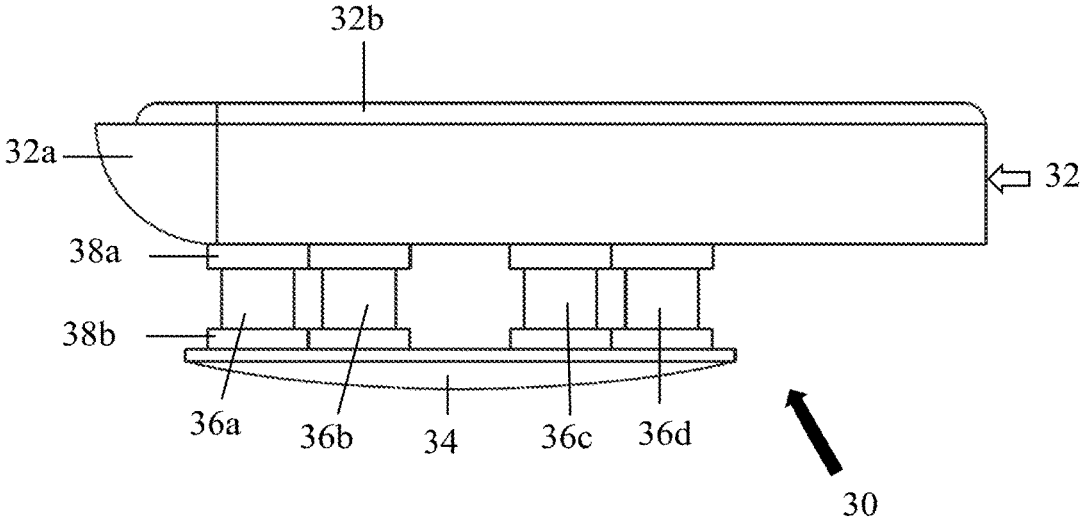
FIG. 4*a*: Side view of a body part protecting device 30 according to an embodiment of the invention.
Figure 4B:
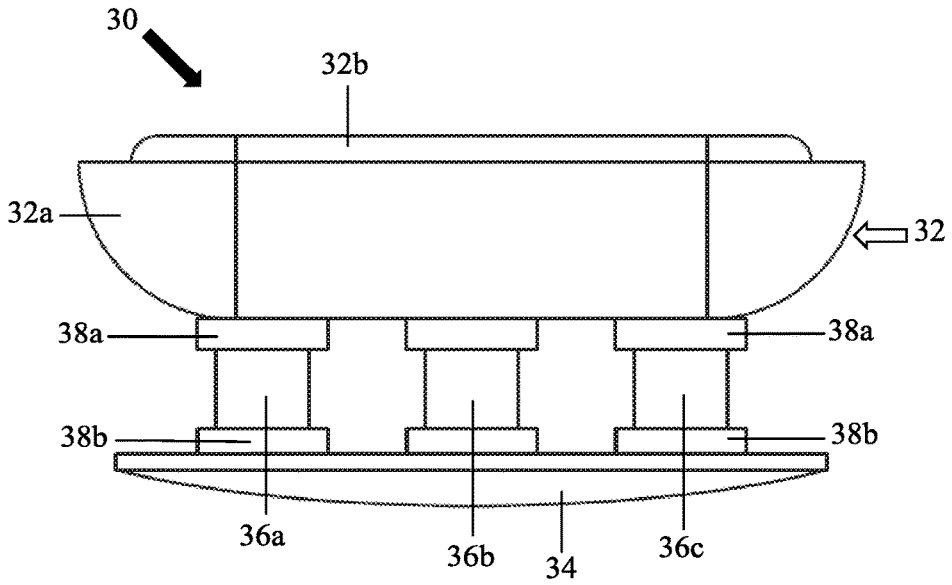
FIG. 4*b*: Front view of the body part protecting device 30 shown in FIG. 4*a*.
Figure 4C:
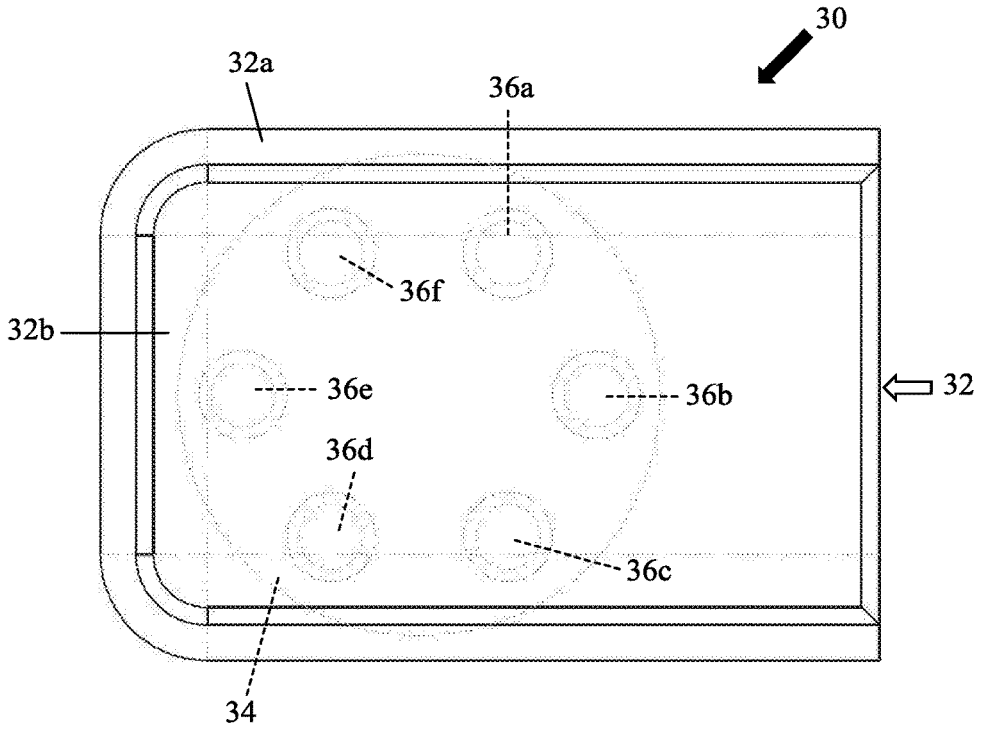
FIG. 4*c*: Top view of the body part protecting device 30 shown in FIGS. 4*a* and *b*.

FIGS. 4*a-c* provide side, front and top views of a knee protection device 30 according to a further embodiment of the invention. Device 30 comprises body contact portion 32, surface contact portion 34 and a plurality of shock absorbing elements 36 which are disposed therebetween.

In FIGS. 4*a*-4*c*, body part contact portion 32 is represented as having a substantially flat surface to contact a body part, but the skilled person will understand that other shapes and forms of body contact portion 32 are envisaged and within the scope of this invention, for example, body contact portion 32 may be curved so as to accommodate an elbow or knee.

In this embodiment, body contact portion 32 is rectangular in shape and comprises it hard base 32*a* which defines a tray or pocket into which a layer of padding or wadding 32*b* is packed or placed. The wadding or padding 32*b* serves as a cushion between the body part and the hard base material of body part contact portion 32*a*. The layer of padding or wadding 32*b* may comprise a soft material, for example a silicone, (encapsulated) gel, plastic, fabric, sponge and/or rubber material.

Body part contact portion 32 has a larger surface area than surface contact portion 34.

Surface contact portion 34 is circular in shape and the surface which domed or curved curved (convex) on the contact surface side. In use, this ensures that the surface contact portion 34 is in contact with a surface through a single point of contact and it enables the user to shift their body weight, rotate a protected body part by up to 360° and shift or move across the surface easily (for example while crawling and/or sliding).

The plurality of discrete shock absorbing elements 36*a-f* are disposed between body part contact portion 32 and the surface contact portion 34; in this embodiment they are distributed in a circular configuration. This provides an even distribution of the user's weight across the entire surface of surface contact portion 34 and assists the user shifting the body weight towards one side of the device, for example while rocking and/or moving across a surface. This feature greatly enhances the mobility of the user, while providing adequate protection for a body part.

Shock absorbing elements 36 are releasably attached to body contact portion 32 and surface contact portion 34. In this embodiment, shock absorbing elements 36 are releasably attached to body contact portion 32 and surface contact portion 34 by means of shock absorbing element housings 38.

In FIGS. 4*a* and 4*b*, spring housings 38*a* and 38*b* are shown as located at each end of each shock absorbing element 36. Shock absorbing element 36 and each shock absorbing element housing 38*a* and 38*b* define a shock absorbing unit 40 (see FIG. 5) which is fixed between body contact portion 32 and surface contact portion 34.

FIG. 4*c* best shows the circular configuration of the shock absorbing elements 36*a-f*.

Figure 5A:
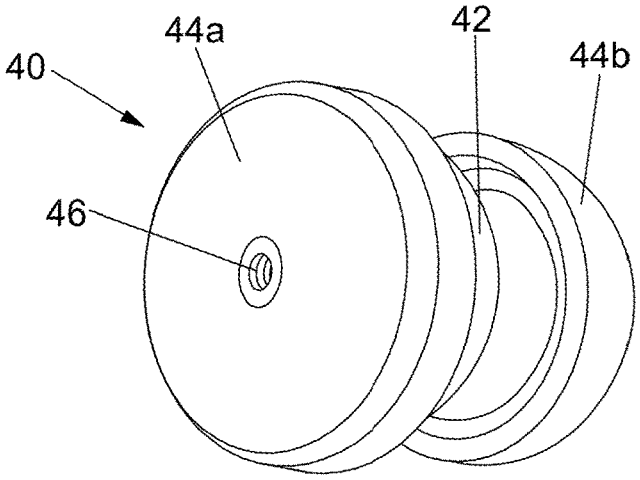
FIG. 5*a*: Picture of a shock absorbing unit 40 comprising a resilient element (spring) located in the resilient element housings according to an embodiment of the invention.

FIGS. 5*a* and *b* are images an individual shock absorbing unit 40 that might be used with a device of the present invention. These shock absorbing units may be sold individually or in kits for replacing broken shock absorbing units and/or for altering the resilience/resistance of a body part protection device of this invention.

Figure 5B:
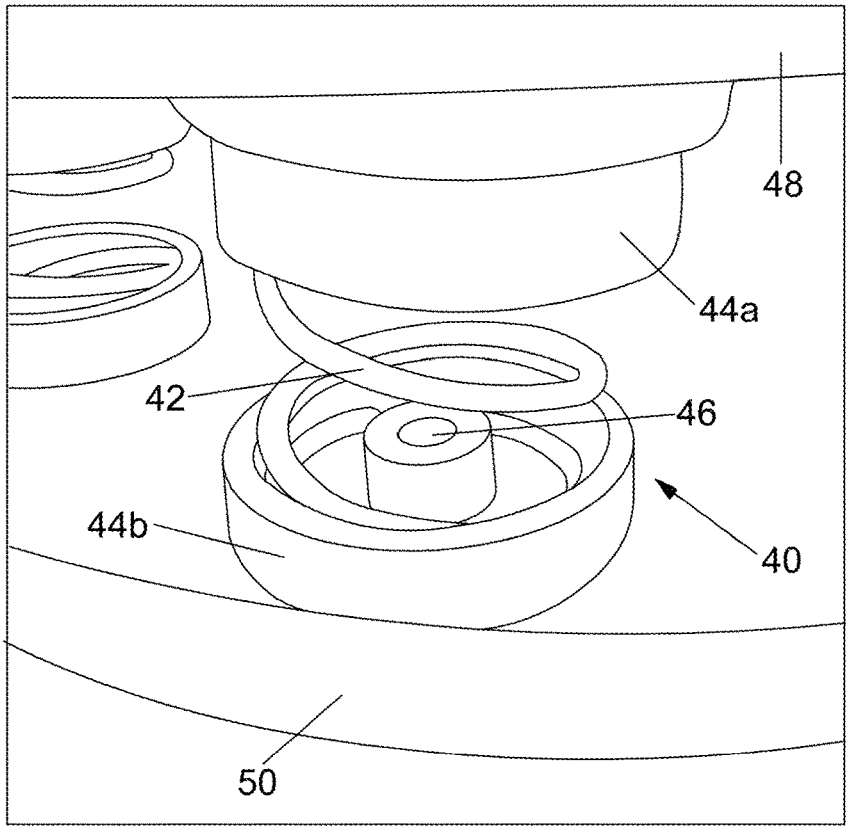
FIG. 5*b*: Picture of the shock absorbing unit 40 shown in FIG. 5*a* releasably secured to the surface contact portion and the body contact portion of a device according to one embodiment of the invention.

Shock absorbing unit 40 comprises a shock absorbing element 42 (a spring) shock absorbing element housings 44*a* and *b* which are attached to either end of shock absorbing element 42. In FIG. 5*b* the shock absorbing units 40 are shown in use and attached to a device of the invention. Housing 44*a* is releasably attached to a port or aperture of the body contact portion 48 of a device of the present invention and housing 44*b* is releasably attached to a port or apertures (not shown) of the surface contact portion 50. The housings 48 may be attached to the device by means of screws that fit into the built in screw thread 46 of the housing of the shock absorbing unit 40.

Figure 6:
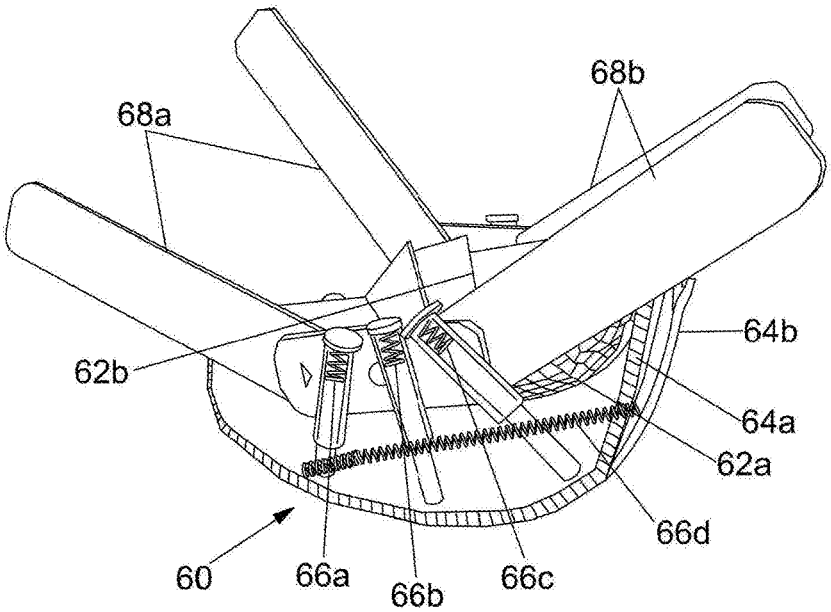
FIG. 6: Picture of a body part protecting device 60 according to a further embodiment of the invention.

FIG. 6 is an image of body part protection device 60 according to another embodiment of the invention. The device comprises a body part contact portion, which encompasses a concave metal mesh cradle 62*a* adapted to receive a body part, for example a knee. The device further comprises a layer of padding or wadding 62*b* on the inside surface of the body part contact portion, which serves as a cushion between the body part and the hard metal mesh of the body contact portion. The device further comprises a plurality of springs acting as shock absorbing elements 66*a-d*, disposed between the body contact portion and the surface contact portion. One end of each shock absorbing element is connected to the outside surface of the body part contact portion (i.e. the surface which does not face the body part to be protected) and the other end of each shock absorbing element is connected to the inside surface of the surface contact portion. In this embodiment, the shock absorbing elements 66*a-c* are enclosed in a tubular body or housing and the shock absorbing element 66*d* is attached to the surface contact portion, perpendicular to the other shock absorbing elements, in order to maintain the curved shape of the surface contact portion. The surface contact portion comprises a hard material 64*a*, which is curved to allow for rotation and/or movement of the device when in use, without displacement of the protective device across the surface or to provide mobility when the user wants to shift/move across the contact surface. Furthermore, the surface contact portion 64*a* is solid and/or continuous to provide a single point of contact with the surface wherein in use and it comprises a surface contact sole 64*b* made of a soft gripping material to provide better grip of the device on the surface. The device also comprises strap holders 68*a* and *b* to provide a means of securing straps (not shown here) for attaching the device to locations above and/or below (for example either side of) the knee and/or elbow.

FIGS. 7*a-e* show top, side, longitudinal cross-section, front and cross-section views of a knee protection device 70 according to a further embodiment of the invention. Device 70 comprises body contact portion 72, surface contact portion 74 and a plurality of shock absorbing elements 76 which are disposed therebetween.

Figure 7A:
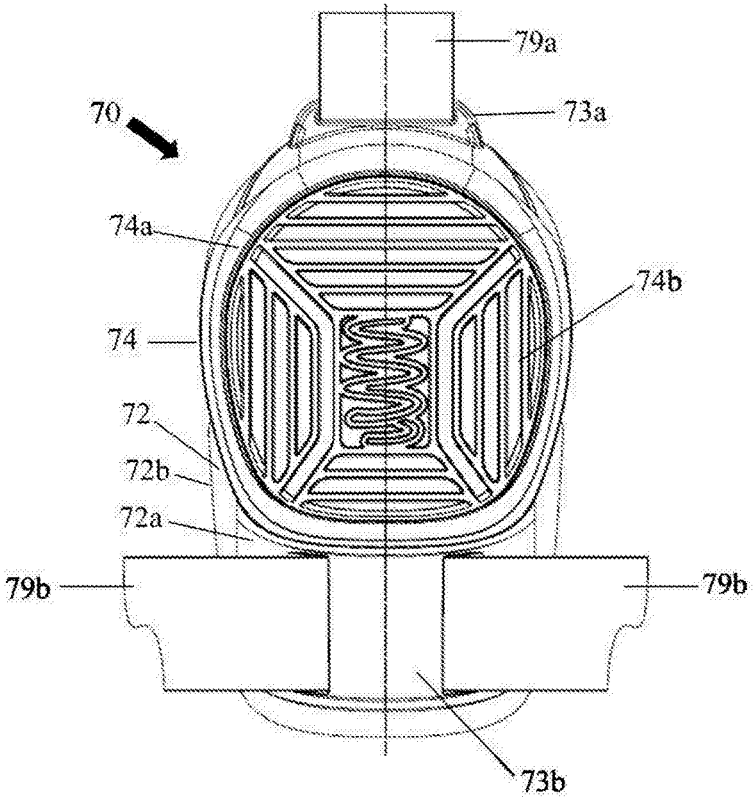
FIG. 7*a*: Top view of body part protecting device 70 according to another embodiment of the invention.

FIG. 7*a* best shows surface contact portion 74 and the strap holders 73*a* and *b* that hold straps 79*a* and *b*. Strap 79*a* is configured to secure device 70 to the thigh of the wearer while strap 79*b* is configured to secure the device to the shin of the wearer. By means of the straps the device can be securely located and held in position to provide the maximum impact protection to the wearer.

The body contact portion 72 of device 70 consists of an elongated cradle or tray of hard material 72*a* which is configured to host a layer of padding or wadding 72*b* for providing additional comfort and pressure release from the wearer's joint. The padding or wadding 72*b* may comprise any suitable soft material such as rubber, foam, viscoelastic polyurethane foam, (encapsulated) gel, silicone, fabric, sponge and the like.

Body part contact portion 72 has a larger surface area than surface contact portion 74.

Figure 7B:
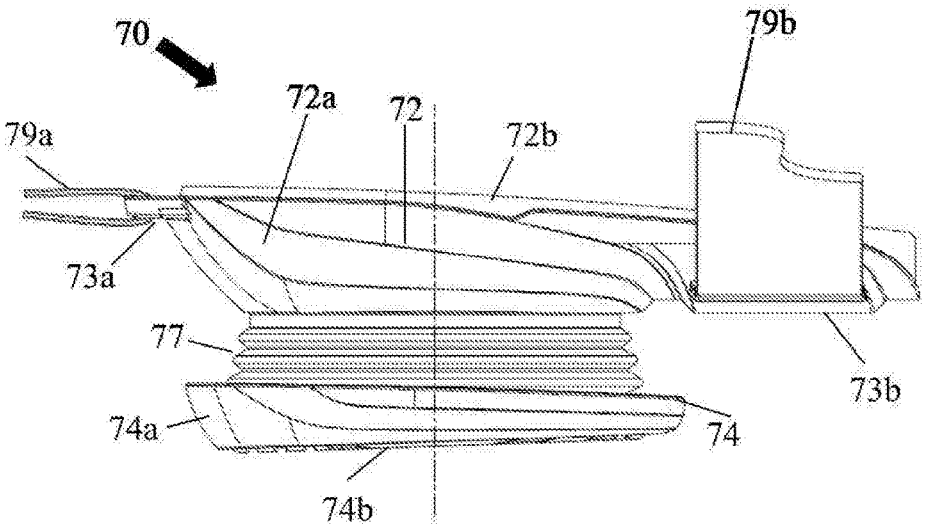
FIG. 7*b*: Side view of body part protecting device 70.

Surface contact portion 74 comprises a hard material base 74*a* to provide stability and a soft material sole 74*b* to prevent damage of the surface on which the device rests. FIG. 7*b* clearly shows that surface contact portion 74 has a wedge shape being fatter or thicker at one end than is at the other. As seen in FIGS. 7*a* and 7*b*, the surface contact portion sole 74*b* defines a profiled surface. Without wishing to be bound by theory, the profiled sole 74*b* may provide additional grip on the surface and prevent sliding or shifting while the wearer performs an activity which involves leaning a joint on a hard surface. The surface contact portion sole may comprise any suitable material such as rubber, plastic, silicone and the like. As best observed in FIGS. 7*b-e* surface contact portion 74 has a flat profile in order to provide maximum stability on the location on which the joint rests. However, surface contact portion 74*a* defines rounded edges. This may prevent the user from getting entangled onto obstacles or items that lie on a surface.

Figure 7C:
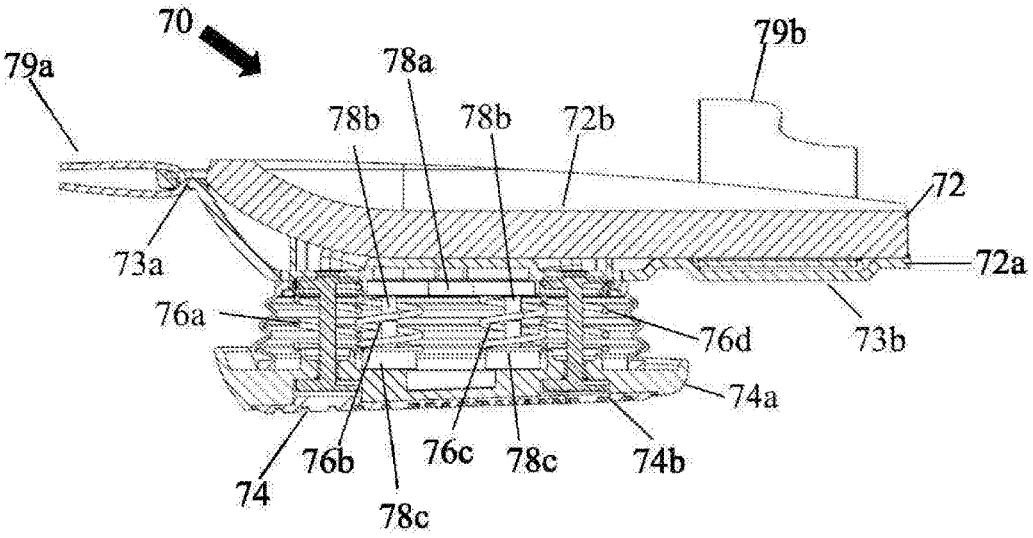
FIG. 7*c*: Longitudinal cross-section of body part protecting device 70.
Figure 7D:
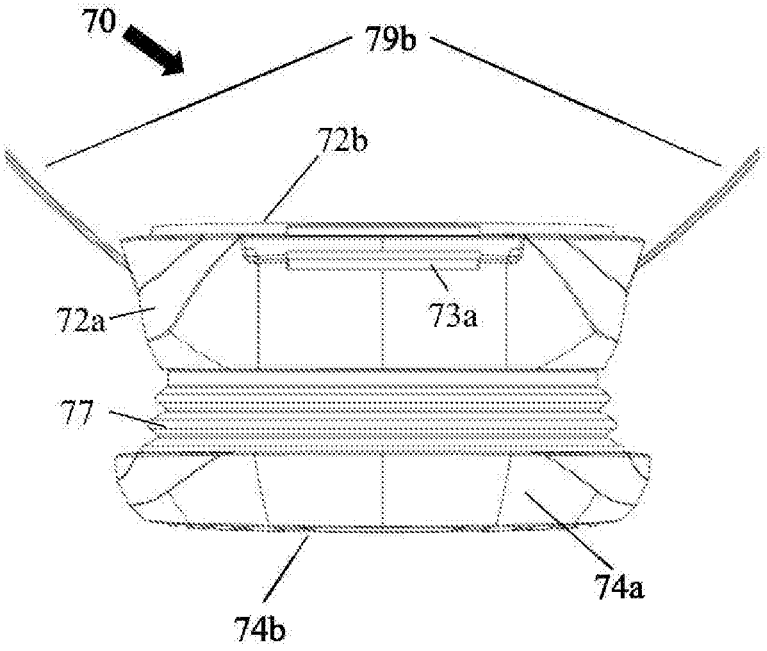
FIG. 7*d*: Front view of body part protecting device 70.

As best observed in FIGS. 7*b* and 7*d*, device 70 further comprises a flexible and corrugated sheath 77, which encircles the cavity containing the shock absorbing elements 76. Sheath 77 may comprise any suitable flexible material, such as fabric, plastic, rubber and the like. Sheath 77 protects shock absorbing elements 76 from the ingress of dirt, dust, moisture and/or substances that may damage or decrease the performance of the shock absorbing elements. Also shown in this figure are body contact portion 72 which in this image is shown to comprise a part 72*a* which accommodates the knee and which is lined with a layer of padding or wadding 72*b*. Further, body contact portion 72 is shown to extend such that it further provides a guard or shield protecting part of the front of the shin. It is from this part of body contact portion 72 through which strap 79*b* is thread such that it can be affixed around a user's shin.

Figure 7E:
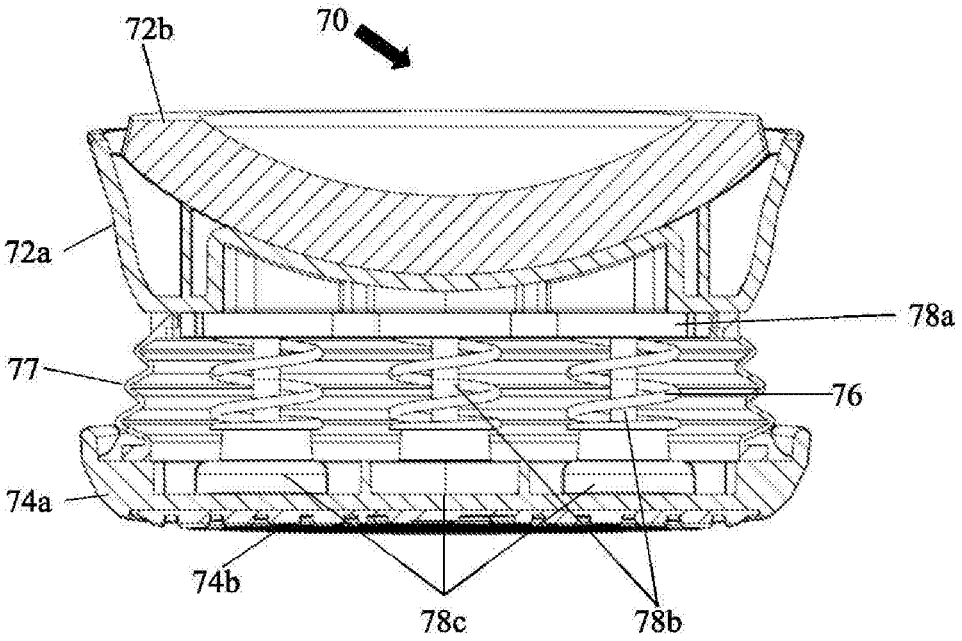
FIG. 7*e*: Cross-section of body part protecting device 70.

FIGS. 7*c* and 7*e* show cross-sections of the device. As seen in FIG. 7*c*, device 70 comprises shock absorbing elements (visible here are elements 76*a, b, c* and *d* and not visible are 76*e* and *f*) which in this embodiment take the form of springs mounted on shock absorbing housings 78*a* and 78*c*. In device 70 the 6 shock absorbing elements 76*a-f* distributed in a circular arrangement. Device 70 is configured to be placed on or against a user's joint and in use shock absorbing elements 76*a* surrounding the apex or centre point of the joint. Without wishing to be bound by theory, this design may provide an enhanced distribution of the pressure load across the entire device and decrease the strain suffered by the wearer. As such, device 70 may be configured so as not to comprise any shock absorbing element located directly under the apex of the joint of the wearer.

Shock absorbing housing 78*a* consists of a walled recess defined by the body contact portion 72. Shock absorbing housing 78*c* consists of an abutment or stump which can extend up into the each spring shock absorbing element 76*a-f*. The shape and size of shock absorbing housing 78*c* is configured to match the internal diameter and shape/size of each shock absorbing element 76*a-f* in order to provide a snug fit and secure the shock absorbing elements in place. Under compression or in use (i.e. when body contact portion 72 is brought towards surface contact portion 74) abutment 78*c* is configured to fit within recess 78*a*. Through the centre of each shock absorbing element 76*a-f* are also provided cord fasteners 78*b*. Cord fasteners 78*b* are connected to surface contact portion 74 and body contact portion 72 and are configured to be fed through shock absorbing elements 76. Cord fasteners 78*b* may comprise any suitable material; for example, cord fasteners 78*b* may comprise a flexible plastic, string, rubber or the like. Beneficially, cord fasteners 78*b* may be compressed together with shock absorbing elements 76 and upon return of the shock absorbing elements 76 to the extended (uncompressed) configuration, the cord fasteners 78*b* may secure the shock absorbing elements 76 in place, not allowing their displacement away from the shock absorbing element housings 78*a* and 78*c*. In this embodiment, shock absorbing elements 76*a-f* are springs and cord fasteners 78*b* are located within the void of the each spring 76*a-f*. Without wishing to be bound by theory, this provides additional stability to the shock absorbing elements and prevents lateral displacement. Furthermore, cords 78*b* assist in the assembly of shock absorbing elements 76*a-f* onto the device. Shock absorbing housing 78*a* defines a port or aperture into which the top end of shock absorbing element 76 and cord fastener 78*b* can be secured. Each cord fastener 78*b* may take the form of a "treasury tag" or "India tag" (i.e. a tag with orthogonal cross-pieces) which can be easily threaded into place. The lower end of each shock absorbing element 76*a-f* is secured onto shock absorbing housing 78*c*, as well as the lower end of cord fastener 78*b*. Shock absorbing housing 78*a* is defined by body contact portion 72*a* while shock absorbing housing 78*c* is secured to or defined by surface contact portion 74*a*.

Figure 8:
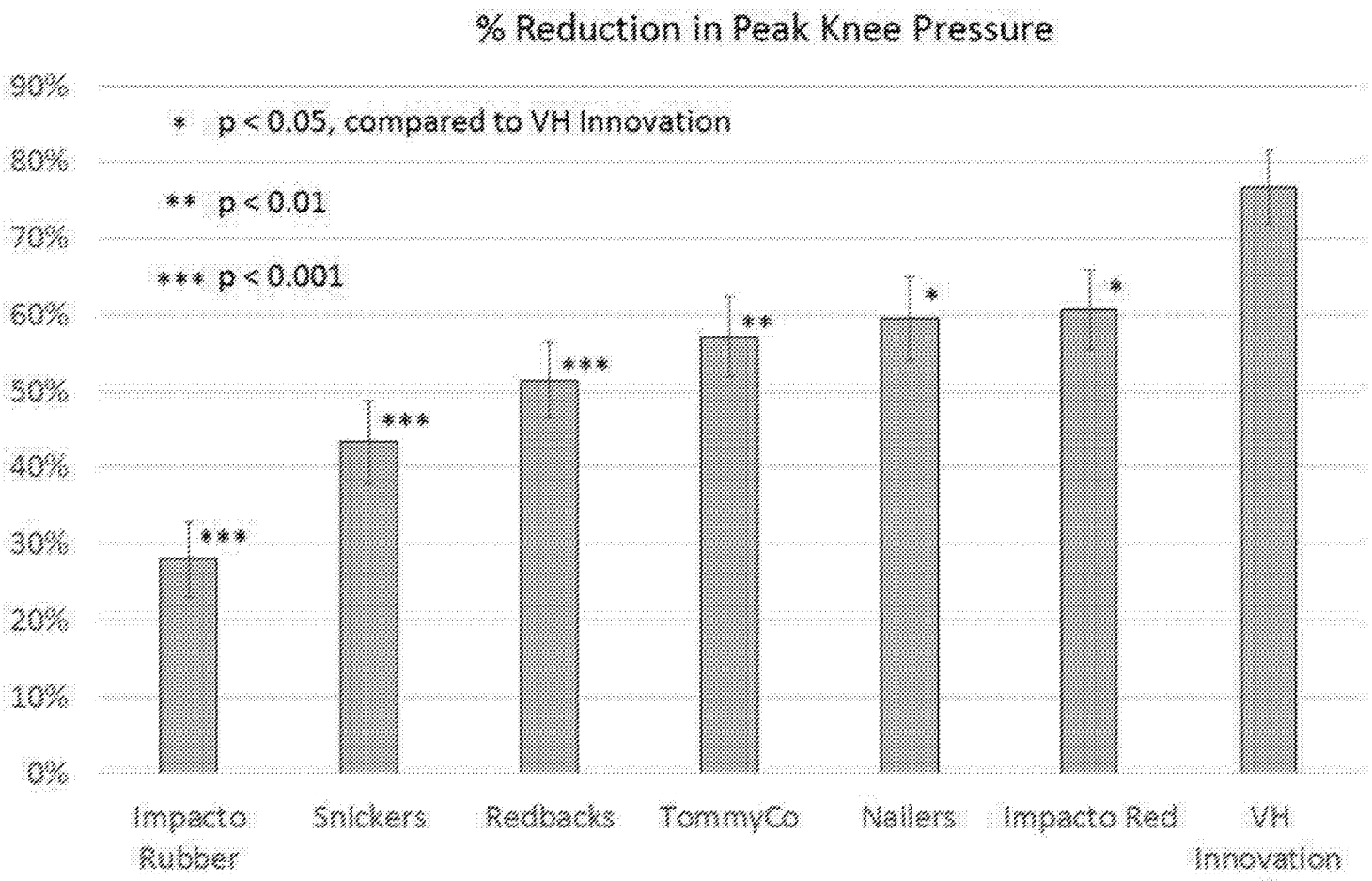
FIG. 8: Graph displaying the % reduction in peak knee pressure measured on the device of the present invention (VH Innovation) and six other top-of the range commercially available knee pads.

FIG. 8 is a graph representing the results of a study aiming to identify the optimum spring characteristic for a joint protection device of the invention and comparing the peak pressures developed on the knee during kneeling with commercially available knee pads. Kneeling poses a risk to the development of medial tibiofemoral osteoarthritis and infrapatellar bursitis. Therefore future knee pad designs should focus on reducing the pressure to the bursa areas along the patellar tendon and tibial tubercle.

Following ethical approval, 5 male and 3 female volunteers were recruited. All self-diagnosed themselves to be free of current knee problems.

Participants performed a double knee descend twice on the floor and the pressure profile across their knee was recorded using a pressure mat (3100, Tekscan Inc., Boston, US) placed between the knee pad and knee. Participants randomly wore six versions of a prototype joint protection device of the invention (VHinnovation) utilising combinations of 22 mm and 25 mm springs each with 6, 8 and 14 N/mm stiffness. Subsequently, participants randomly wore one of six commercial knee pads (Nailers®, TommyCo®, Snickers®, Redbacks®, Impacto® Red, Impacto® Rubber) together with a no knee pad condition.

Peak pressures were normalised by the peak pressure developed during kneeling without a knee pad. ANOVA was used to analyse whether normalised peak pressure varied between knee pads and between genders.

Peak pressure without a knee pad significantly correlated with body mass ($r=0.49$ $p<0.001$), but normalised peak pressure did not, giving confidence to the normalization assumption catering for both kinematic and inertial differences between participants. For the joint protection devices of the invention, a gender difference existed whereby, on average across all designs, females reduced their peak pressure by 77+/−4% using knee pads, whilst men experienced a 60+/−3% reduction ($p<0.01$). Statistically, there was no difference between the various prototypes of the joint protection device of the invention. However, since the 22 mm 8 N/mm spring had the lowest normalised peak pressure on average, reducing pressure by 76.6+/−6%, this design was compared against the other market competitors.

Significant differences were found between pad designs (FIG. 8) with regards to peak pressures ($p<0.001$). Post hoc t-tests demonstrated the average normalised peak pressure reduction achieved with the new design was significantly better than all other competitor brands with the nearest competitor achieving a 60.7% reduction in peak force. Females reduced their peak pressure by 58.3+/−2.9% whilst men obtained a 49.3+/−2.6% reduction ($p<0.05$) across all knee pads.

The joint protection device of the invention adopting 22 mm, 8 N/mm springs achieved significantly greater reductions in peak pressures during kneeling compared to market competitors. Without wishing to be bound by theory, if peak pressures translate into knee injury, then the joint protection device of the invention may have the potential to reduce such pathologies.

Figure 9:
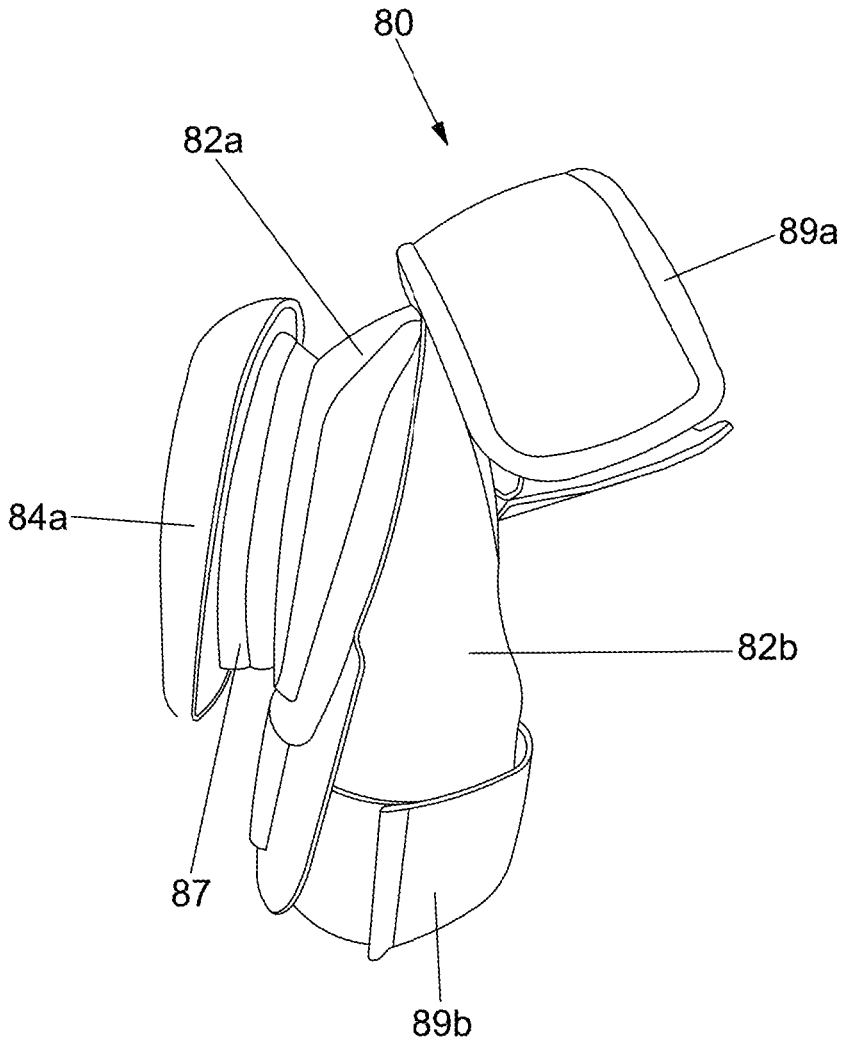
FIG. 9: Image of the side view of body part protecting device 80.

FIG. 9 shows an image of the side view of a knee protection device 80 of the present invention. Device 80 comprises a body contact portion comprising an elongated cradle 82 fabricated from a relatively stiff material, that hosts a layer of padding or wadding 82*b* comprising a soft resilient material. In use, the layer of padding or wadding 82*b* hosts the user's knee. The components of device 80 are the same as those of device 70 but the layer of padding or wadding 82*b* extends beyond the cradle to provide wings or flaps which curve up in order to accommodate and surround the user's shin. In use, the layer of padding or wadding 82*b* hugs the user's shin, securing device 80 in place. Straps 89*b* are fastened over the layer of padding or wadding 82*b* while straps 89*a* are secured to the user's thigh in order to prevent displacement of the device when in use. Device 80 also comprises a surface contact portion 84*a*, which comprises a surface contact sole or surface protection layer 84*b* (not shown). The shock absorbing elements of the device (not shown) are covered with a protective sheath 87, which comprises a soft resilient material such as rubber. Sheath 87 may comprise any suitable flexible material, such as fabric, plastic, rubber and the like. Sheath 87 may protect the shock absorbing elements from dirt, dust and/or substances that may damage or decrease the performance of the shock absorbing elements.

Figure 10:
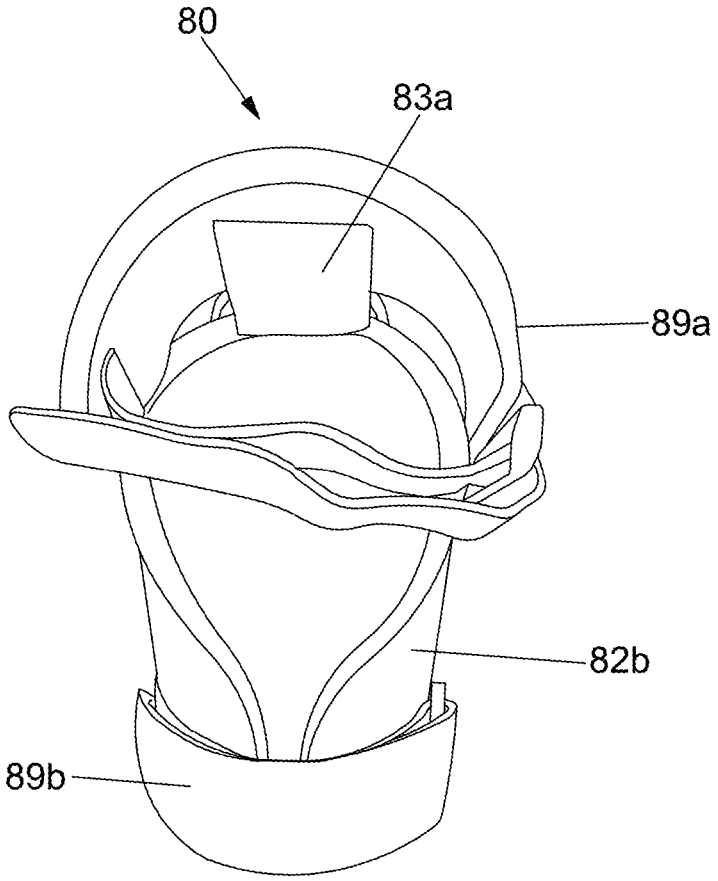
FIG. 10: Image of the top view of body part protecting device 80.

FIG. 10 is an image of the top view of device 80. This figure best shows the configuration of the layer of padding or wadding 82*b* extending beyond the cradle upwards and curving inwards in order to receive a user's knee and surround a user's shin. It can also be observed that straps 89*b* are fastened over the layer of padding or wadding 82*b*. Beneficially, this configuration may provide secure location of the device in place while reduce the discomfort that straps attached to the user's leg without a cushioning layer may lead to.

Figure 11:
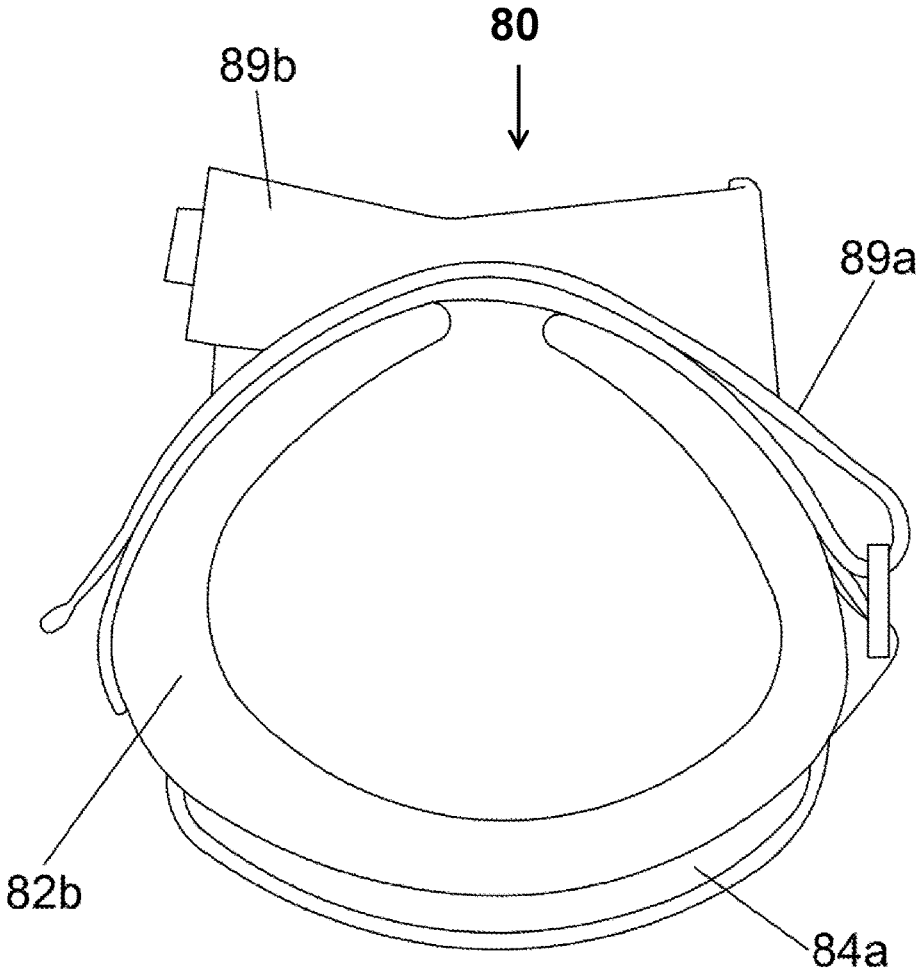
FIG. 11: Image of the back view of body part protection device 80.

FIG. 11 is an image of a front view of device 80 with surface contact portion 84*a* leaning against a surface. The curvature of the layer of padding or wadding 82*b* can be appreciated in this image.

Those skilled in the art will recognise that the above-described embodiments are merely exemplary of the present invention and that various modifications and improvements may be made thereto without departing from the scope of the invention. Furthermore, the various embodiments described above include a number of different features. It will be recognised by those of skill in the art that many of these features offer advantages independently of the other features present in the embodiments and could be incorporated in other aspects of the invention.

The invention claimed is:

1. A device for protecting a joint, said device comprising:
- a body part contact portion;
- a surface contact portion; and
- a plurality of discrete shock absorbing elements disposed between the body part contact portion and the surface contact portion;
- wherein the shock absorbing elements are circumferentially arranged around a vertical axis located in the centre of the surface contact portion;
- wherein the shock absorbing elements comprise springs;
- wherein the body part contact portion and the surface contact portion comprise a plurality of shock absorbing element housings, each shock absorbing element being associated with at least one shock absorbing element housing;
- wherein the device comprises a plurality of flexible members extending between the body part contact portion and the surface contact portion and configured to prevent the shock absorbing elements from breaking free of the housings, each shocking absorbing element being associated with at least one of the flexible members wherein the plurality of flexible members are flexible cords designed to be fed through each of the plurality of the discrete shock absorbing elements.

2. The device of claim 1, wherein the joint is a knee joint or an elbow joint.

3. The device of claim 1, wherein in use, there is no shock absorbing element located directly under an apex of the joint or the shock absorbing elements are circumferentially arranged around the joint.

4. The device of claim 1, wherein one or more of the discrete shock absorbing elements is capable of removal from the device.

5. The device of claim 1, wherein the shock absorbing elements are each independently removable or interchangeable.

6. The device of claim 1, wherein the body part contact portion and the surface contact portion define ports for releasably receiving the shock absorbing elements.

7. The device of claim 1, wherein the shock absorbing elements are capable of being arranged or distributed in a plurality of configurations.

8. The device of claim 1, wherein the shock absorbing elements are capable of being alternated, replaced or interchanged with shock absorbing elements of low, medium or high stiffness, deformability, spring rate or compression properties.

9. The device of claim 1, wherein the device further comprises a fastening for releasably securing the device to or around a joint to be protected.

10. The device of claim 1, wherein the surface contact portion or body part contact portion comprises one or more materials selected from the group consisting of:

(i) a hard or resilient material or materials;
(ii) metal;
(iii) plastic;
(iv) rubber;
(v) wood;
(vi) fabric;
(vii) composite materials; and
(viii) any combination of (i) to (vii).

11. The device of claim 1, wherein the body part contact portion comprises a cradle which accommodates, houses or fits against or around or at least partially encloses the joint to be protected.

12. The device of claim 1, wherein the body part contact portion comprises a layer of padding or wadding that, in use, cushions the joint.

13. The device of claim 1, wherein the surface contact portion comprises a solid or continuous component.

14. The device of claim 1, wherein the surface contact portion comprises a substantially flat or planar surface for contact with a surface.

15. The device of claim 1, wherein the surface contact portion comprises a sole or surface protecting layer.

16. The device of claim 15, wherein the sole or surface protecting layer increases the grip of the device on a surface.

17. The device of claim 1, further comprising a flexible sheath disposed between the body part contact portion and the surface contact portion, the sheath being adapted to protect the shock absorbing elements from the ingress of debris.

* * * * *